US007302781B2

(12) United States Patent
Michler et al.

(10) Patent No.: US 7,302,781 B2
(45) Date of Patent: Dec. 4, 2007

(54) BANDER APPARATUS AND METHOD OF USING SAME

(75) Inventors: James R. Michler, Ashland, WI (US); Thomas W. Schneider, Grand View, WI (US); Thomas J. Palokangas, Ashland, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 0 days.

(21) Appl. No.: 10/945,858

(22) Filed: Sep. 21, 2004

(65) Prior Publication Data

US 2006/0059863 A1 Mar. 23, 2006

(51) Int. Cl.

| | |
|---|---|
| ***B65B 13/18*** | (2006.01) |
| ***B65B 57/02*** | (2006.01) |
| *B65B 13/20* | (2006.01) |
| *B65B 27/08* | (2006.01) |

(52) U.S. Cl. ..... 53/399; 53/504; 53/66; 53/582; 53/389.3

(58) Field of Classification Search ..... 53/505, 53/74, 64, 209, 590, 389.3, 66, 504, 399
See application file for complete search history.

(56) References Cited

U.S. PATENT DOCUMENTS

| | | | | |
|---|---|---|---|---|
| 1,599,993 | A * | 9/1926 | Duplay | 53/66 |
| 1,711,228 | A * | 4/1929 | Duvall et al. | 53/209 |
| 2,636,654 | A * | 4/1953 | Sykes | 53/389.3 |
| 3,001,352 | A * | 9/1961 | Harrison | 53/389.3 |
| 3,250,052 | A * | 5/1966 | Hyer | 53/66 |
| 3,564,810 | A | 2/1971 | Faletti et al. | |
| 3,710,536 | A * | 1/1973 | Lee et al. | 53/399 |
| 3,729,886 | A * | 5/1973 | Lucas et al. | 53/399 |
| 3,791,100 | A * | 2/1974 | Monaghan | 53/74 |
| RE28,277 | E | 12/1974 | Wright et al. | |
| 3,982,375 | A | 9/1976 | Focke | |
| RE29,362 | E | 8/1977 | Reid | |
| 4,167,841 | A | 9/1979 | Camp | |
| 4,272,944 | A | 6/1981 | Suga | |
| 4,328,655 | A | 5/1982 | Spencer et al. | |
| 4,499,706 | A | 2/1985 | Scheller | |
| 4,525,977 | A | 7/1985 | Matt | |
| 4,553,368 | A * | 11/1985 | Ziller | 53/64 |
| 4,573,305 | A | 3/1986 | Wildmoser | |
| 4,574,566 | A | 3/1986 | Eaves | |
| 4,726,168 | A | 2/1988 | Seko | |
| 4,872,302 | A | 10/1989 | Van Eijsden et al. | |
| 4,964,258 | A | 10/1990 | Seko et al. | |

(Continued)

*Primary Examiner*—Stephen F. Gerrity
(74) *Attorney, Agent, or Firm*—Reinhart Boerner Van Deuren P.C.

(57) ABSTRACT

A method and apparatus for wrapping stacks of web product with wrap web material supplied from a supply roll. The apparatus includes a conveyor for supporting and moving the stacks to be wrapped along a conveying path, a drive assembly operable to receive wrap material from the supply roll and positively feed the wrap material to the conveying path, and a wrapping assembly for manipulating the wrap material around the stack. The method includes supporting and moving the stacks to be wrapped along a conveying path, rotating a cutting roll, clean cutting the wrap material received from the supply roll to separate a wrap sheet from the wrap material, defining a trailing edge of the wrap sheet, delivering the trailing edge to the conveying path after the wrap sheet is separated from the wrap material, and manipulating the wrap sheet around the stack.

19 Claims, 9 Drawing Sheets

U.S. PATENT DOCUMENTS 4,989,397 A 2/1991 Tomac et al.
5,033,250 A * 7/1991 Josefek et al. ..... 53/64
5,347,791 A 9/1994 Ginzl et al.
5,428,937 A 7/1995 Misik
5,485,712 A 1/1996 Cherney et al.
5,524,413 A 6/1996 Fukuda
5,524,420 A 6/1996 Ikuta
5,706,635 A 1/1998 Simmons
5,797,247 A 8/1998 Nakagoshi et al.
5,846,619 A 12/1998 Cahill et al.
5,884,458 A 3/1999 Alvarez
5,966,908 A 10/1999 Philipp et al.
5,979,145 A 11/1999 Louis et al.
6,050,065 A 4/2000 Bonde
6,122,894 A 9/2000 Romagnoli
6,128,888 A * 10/2000 Gambetti ..... 53/589
6,131,373 A 10/2000 Cherney
6,195,966 B1 3/2001 Shomron et al.
6,233,903 B1 5/2001 Ide
6,256,969 B1 7/2001 Fragstein
6,374,580 B1 4/2002 Kujubu et al.
6,675,552 B2 1/2004 Kunz et al.
6,820,397 B2 11/2004 Haasl
2001/0009089 A1 7/2001 Todd et al.
2002/0055803 A1 5/2002 Stork et al.
2003/0106286 A1 6/2003 Rosloot et al.
2004/0020169 A1 2/2004 Haasl
2004/0068966 A1 4/2004 Haasl
2004/0083690 A1 5/2004 Gambetti

* cited by examiner

BANDER APPARATUS AND METHOD OF USING SAME

FIELD OF THE INVENTION

The present invention relates to apparatuses and methods for the production and packaging of web products, and more particularly to apparatuses and methods for banding stacks of web products.

BACKGROUND OF THE INVENTION

Prior art banding systems, such as the banding system 10 of FIGS. 1-4, generally include feed conveyors 12, which move logs 14 of web product toward a wrapping station 16. Typically, the wrapping station 16 includes a roll 18 of wrap material 20, which is positioned adjacent to the feed conveyor 12 to supply wrap web material 20 to the wrapping station 16. As shown in FIG. 1, the roll 18 typically feeds wrap material 20 through a cutting assembly 24 and onto a discharge conveyor 26.

Conventional cutting assemblies 24 generally include an anvil 30 having an outwardly extending knife blade 32 and a rotatable cutting roll 34 having an outwardly extending knife blade 36. In operation, the cutting roll 34 is rotated about its axis to intermittently and selectively engage the wrap material 20 between the blade 36 of the cutting roll 34 and the blade 32 of the anvil 30. During this engagement, the blades 32, 36 perforate the wrap material 20, defining a wrap sheet 38.

After being perforated and as shown in FIG. 2, the wrap sheet 38 is typically feed upwardly toward the discharge conveyor 26. The feed conveyor 12 then moves a log 14 across the wrapping station 16 and onto the discharge conveyor 12, thereby pinching the leading edge of the wrap sheet 38 between the leading edge of the log 14 and the discharge conveyor 26. As shown in FIG. 2, the leading edges of the wrap sheet 38 and the log 14 are then aligned. Typically, the discharge conveyor 26 continues to pull the wrap sheet 38 upwardly and an actuator 40 is moved into engagement with the wrap sheet 38 to rip the wrap sheet 38 at the perforation. The discharge conveyor 26 continues to pull the wrap sheet 38 and the log 14 forwardly, aligning the trailing edge of the wrap sheet 38 and the trailing edge of the log 14.

Downstream from the wrapping station 16, the wrap sheet 38 is typically folded upwardly and around the log 14. The log 14 can then be cut into smaller stacks or clips of web product.

SUMMARY OF THE INVENTION

Some embodiments of the present invention provide a bander apparatus for wrapping stacks of web product with wrap web material supplied from a supply roll. The bander apparatus generally includes a conveyor for supporting and moving the stacks to be wrapped along a conveying path, a drive assembly operable to receive wrap web material from the supply roll and positively feed the wrap material to the conveying path, and a wrapping assembly for manipulating the wrap web material around the stack.

In some embodiments of the present invention, the bander apparatus generally includes a conveyor for supporting and moving the stacks to be wrapped along a conveying path and a cutting roll rotatable to clean cut the wrap web material received from the supply roll to separate a wrap sheet from the wrap web material and define a trailing edge of the wrap sheet. The trailing edge is delivered to the conveying path after the wrap sheet is separated from the wrap sheet material. The bander apparatus also includes a wrapping assembly for manipulating the wrap web material around the stack.

In some embodiments, the present invention includes a bander apparatus for wrapping stacks of web product with wrap web material supplied from an unwind roll rotatable about a roll axis. The bander apparatus generally includes a conveyor for supporting and moving the stacks to be wrapped along a conveying path and an unwind assembly including a mandrel operable to support the supply roll. The unwind assembly generally includes a supply roll drive to rotate the mandrel and to positively drive the rotation of the supply roll about the roll axis to unwind wrap web material from the supply roll and supply the wrap web material to the conveying path. The bander apparatus also includes a wrapping assembly for manipulating the wrap web material around the stack.

The invention also provides a method for wrapping stacks of web product with wrap web material supplied from a supply roll. The method generally includes supporting and moving the stacks to be wrapped along a conveying path, receiving wrap web material from the supply roll and positively feeding the wrap material to the conveying path with a drive assembly, and manipulating the wrap web material around the stack.

In addition, the invention provides a method generally including supporting and moving the stacks to be wrapped along a conveying path, rotating a cutting roll, clean cutting the wrap web material received from the supply roll to separate a wrap sheet from the wrap web material, defining a trailing edge of the wrap sheet, delivering the trailing edge to the conveying path after the wrap sheet is separated from the wrap sheet material, and manipulating the wrap sheet around the stack.

Independent features and independent advantages of the present invention will become apparent to those skilled in the art upon review of the following detailed description, claims, and drawings.

BRIEF DESCRIPTION OF THE DRAWINGS

In the drawings, wherein like reference numerals indicate like parts.

Figure 1:
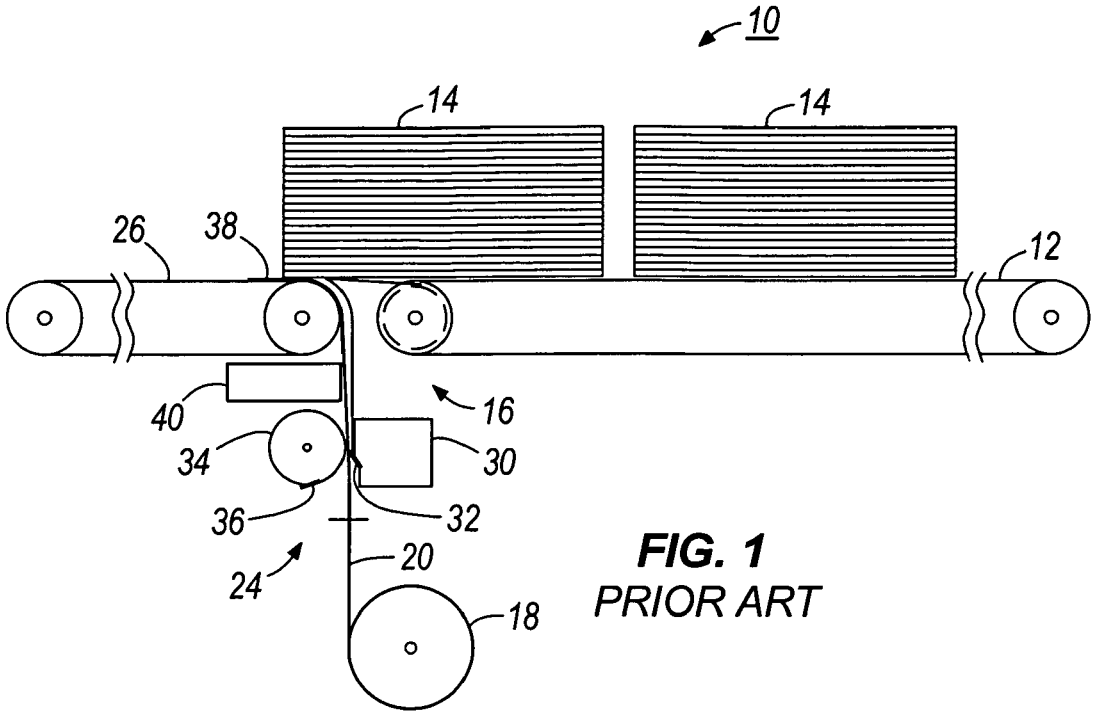
FIG. 1 PRIOR ART
FIG. 1 is a schematic view of a prior art banding apparatus, showing perforated wrap web material being feed toward a first stack of web product.
Figure 2:
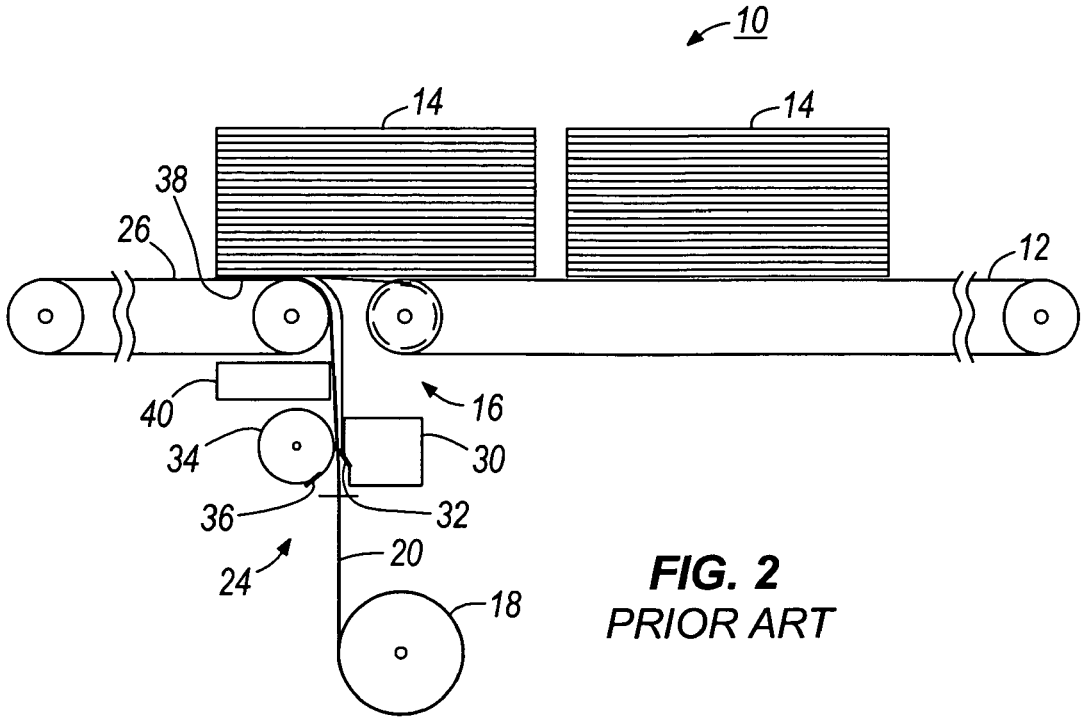
FIG. 2 PRIOR ART
FIG. 2 is a schematic view of the banding apparatus illustrated in FIG. 1, showing the leading edge of the perforated wrap web material aligned with the first stack of web product.
Figure 3:
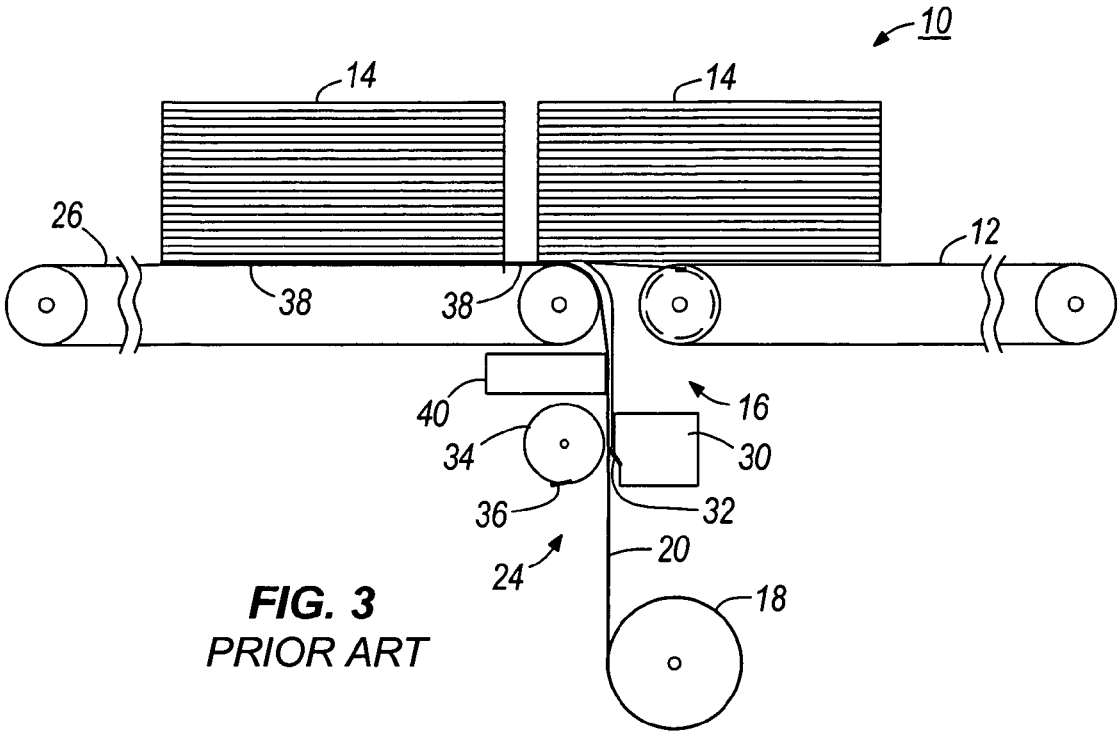
FIG. 3 PRIOR ART
FIG. 3 is a schematic view of the banding apparatus illustrated in FIG. 1, showing the perforated wrap web material being fed toward a second stack of web product.
Figure 4:
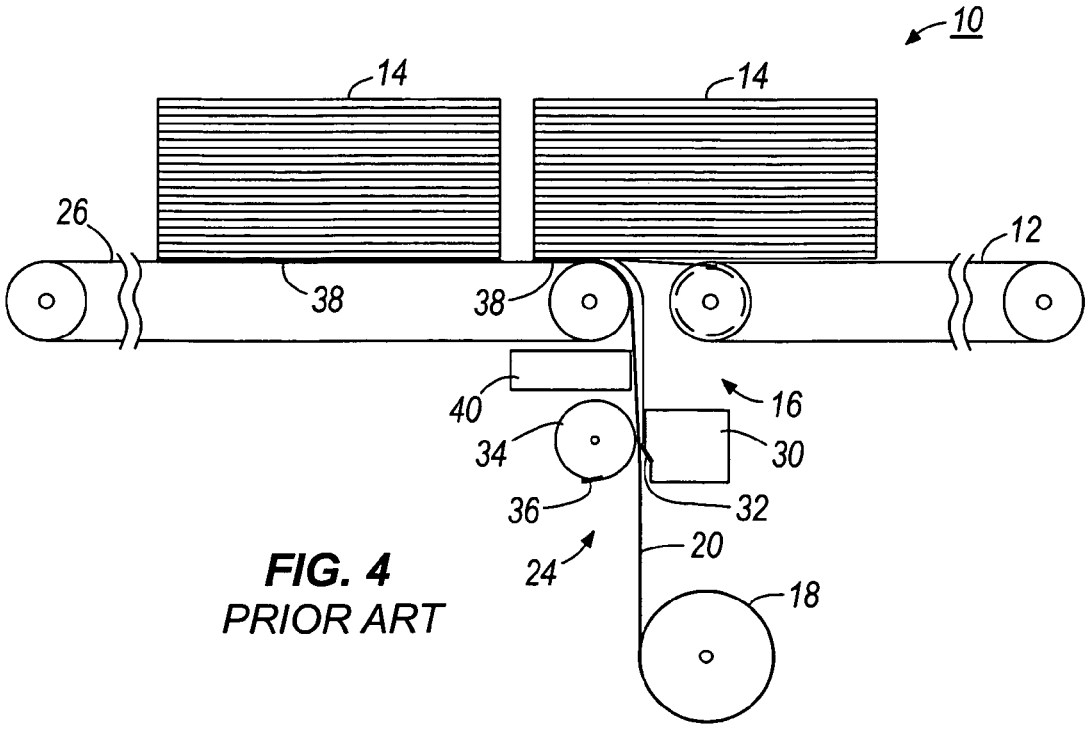
FIG. 4 PRIOR ART
FIG. 4 is a schematic view of the banding apparatus illustrated in FIG. 1, showing a first wrap sheet being separated from the perforated wrap web material.

Before at least one embodiment of the invention is explained in detail, it is to be understood that the invention is not limited in its application to the details of construction and the arrangements of components set forth in the following description or illustrated in the drawings. The invention is capable of other constructions and of being practiced or of being carried out in various ways.

Also, it is to be understood that the phraseology and terminology used herein with reference to element orientation (such as, for example, terms like "front", "top", "bottom", "upper", "lower", "upward", "downward", "upstream", "downstream", etc.) are only used to simplify description of the present invention, and do not alone indicate or imply that the element referred to must have a particular orientation. In addition, terms such as "first" and "second" are used herein for purposes of description and are not intended to indicate or imply relative importance or significance.

DETAILED DESCRIPTION

Figure 5:
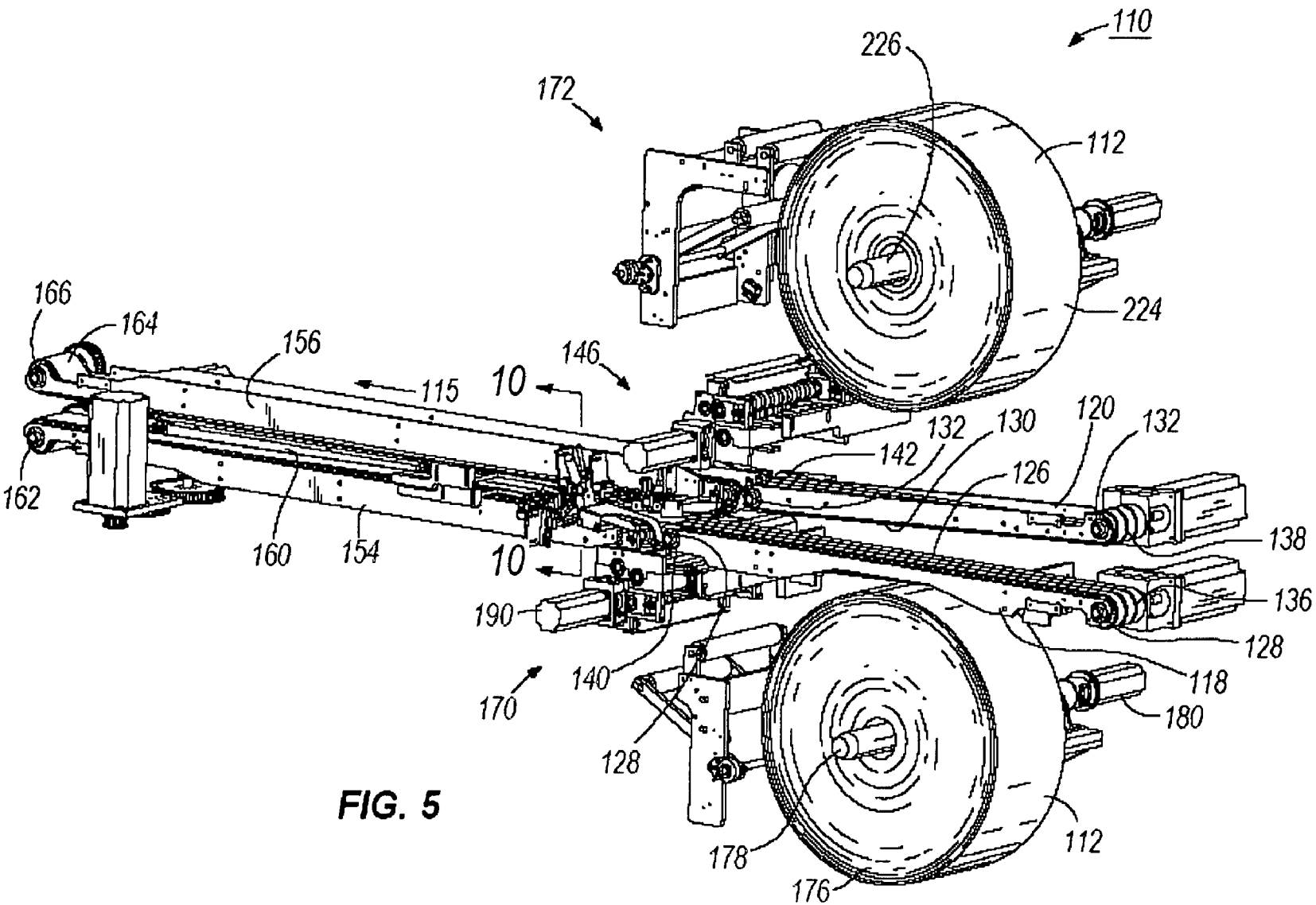
FIG. 5 is a perspective view of the banding apparatus of the present invention.

FIG. 5 illustrates a bander apparatus 110 capable of wrapping sheets of wrap web material (e.g., sleeve stock) 112 around clips or stacks 114 of web product 116. In some embodiments, the bander apparatus 110 is located downstream of other web manufacturing and processing apparatuses, such as an interfolder (not shown, but readily understood by one skilled in the art), which interfolds sheets of web product 116 to form elongated stacks or logs, and a log saw (not shown, but readily understood by one skilled in the art), which cuts the logs to form smaller stacks 114.

In the illustrated embodiment, the stacks 114 include a plurality of interfolded sheets 116, each having first and second free edges. The sheets 116 of the stacks 114 are arranged such that adjacent sheets 116 are folded within and oriented oppositely to adjacent sheets 116. More specifically, the sheets 116 of the stacks 114 are interfolded such that the second free edge of a top sheet 116 is interfolded with the first free edge of an adjacent sheet 116 and such that the second free edge of the adjacent sheet 116 is interfolded with the first free edge of still another adjacent sheet 116. In most embodiments, the entire stack 114 is arranged in this manner except that the first free edge of the top sheet 116 of the stack 114 and the second free edge of the bottom sheet 116 of the stack 114 are not interfolded with free edges of adjacent sheets 116.

While reference is made herein to an apparatus and method for wrapping sheets of web material 112 around stacks 114 of interfolded sheets of web product 116, it should be understood that the banding apparatus 110 and the method of banding disclosed herein can also or alternatively be used to wrap or bind stacks 114 of sheets of web product 116, which are not interfolded.

Figure 6:
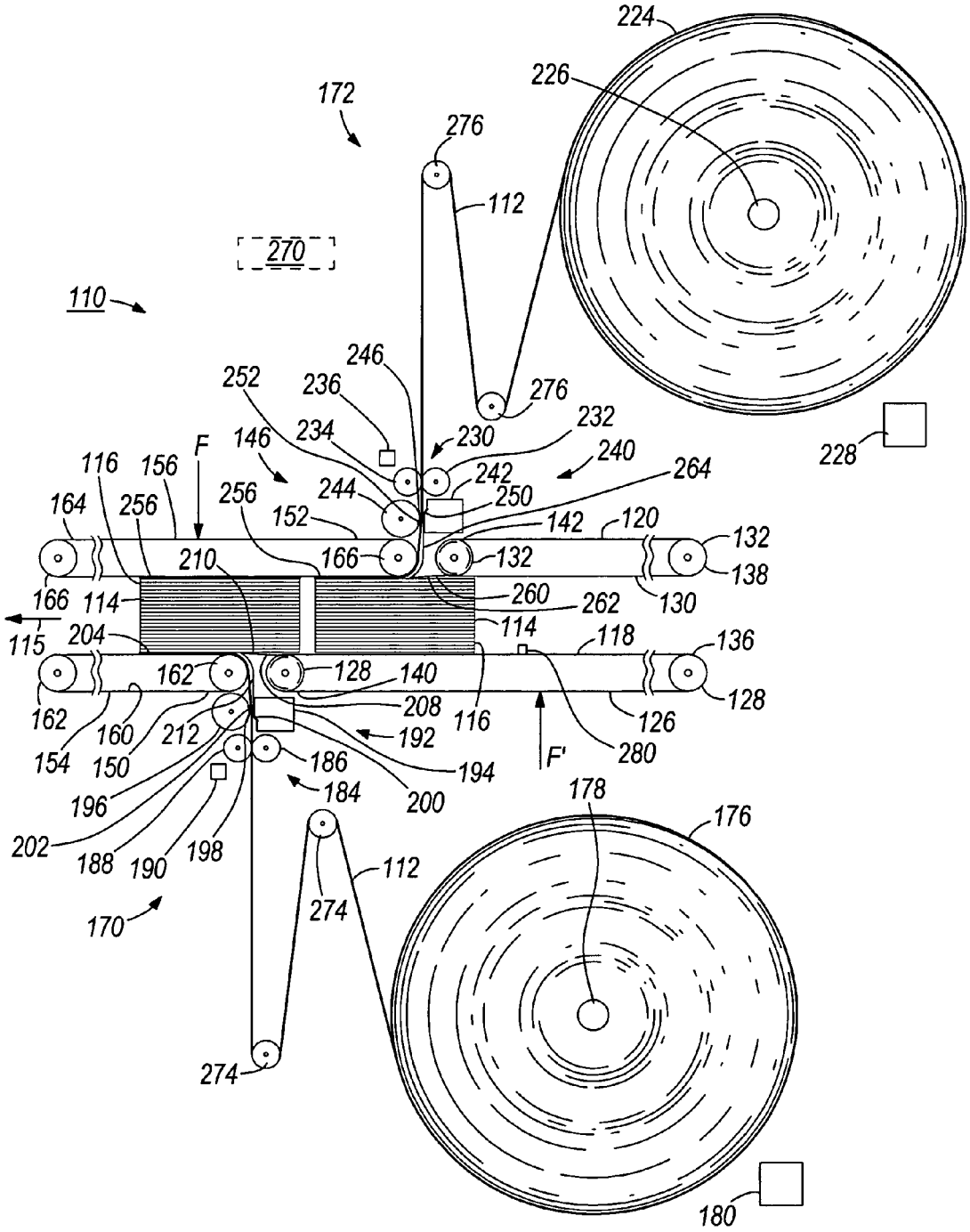
FIG. 6 is a schematic view of the banding apparatus illustrated in FIG. 5, showing cutting rolls cutting wrap web material.

As shown in FIGS. 5-11, the bander apparatus 110 can include lower and upper feed conveyors 118, 120, which receive stacks 114 from upstream apparatuses and are adapted to move the stacks 114 in a downstream direction along a conveying path (represented by arrow 115 in FIGS. 5 and 6). In other embodiments, the bander apparatus 110 can include only a lower feed conveyor 118, which receives stacks 114 from upstream apparatuses and moves the stacks 114 in the downstream direction along the conveying path 115.

In the illustrated embodiment of FIGS. 5-11, the lower feed conveyor 118 includes a belt 126, which moves in the downstream direction along the conveying path 115 around pulleys 128, and the upper feed conveyor 120 includes a belt 130, which also moves in the downstream direction along the conveying path 115 around pulleys 132 at substantially the same speed as the belt 126 of the lower feed conveyor 118. In other embodiments, one or both of the lower and upper feed conveyors 118, 120 can be a vacuum belt, a high friction belt, a paddle conveyor, or any other suitable device for moving the stacks 114 in the downstream direction along the conveying path 115.

In some embodiments, such as the illustrated embodiment of FIGS. 5-11, the upper and lower feed conveyors 118, 120 compress or partially compress the stacks 114 before the stacks 114 are wrapped. In these embodiments, one or both of the lower and upper feed conveyors 118, 120 is angled or sloped inwardly between respective upstream ends 136, 138 and downstream ends 140, 142. More specifically, the upstream end 138 of the upper feed conveyor 120 is spaced a first distance above the upstream end 136 of the lower feed conveyor 118 and the downstream end 142 of the upper feed conveyor 120 is spaced a second, smaller distance above the downstream end 140 of the lower feed conveyor 118.

As the lower and upper feed conveyors 118, 120 move the stacks 114 in the downstream direction along the conveying path 115, the lower and upper feed conveyors 118, 120 apply a force (represented by arrows F, F' in FIG. 6) to the stacks 114 to compress the stacks 114 from a first size to a second, smaller size (e.g., between about 50% and about 90% of their uncompressed size). In some preferred embodiments, the stacks 114 are compressed to approximately 80% of their uncompressed size.

In other embodiments, the stacks 114 are compressed or partially compressed before entering the bander apparatus 110. In these embodiments, the lower and upper feed conveyors 118, 120 receive the compressed or partially compressed stacks 114 from upstream apparatuses and apply a compressive force to the stacks 114 to maintain the stacks 114 in a compressed or partially compressed condition. In some such embodiments, the lower and upper feed conveyors 118, 120 are substantially parallel between respective upstream and downstream ends 136, 138 and 140, 142.

In the illustrated embodiment of FIG. 5-11, the lower and upper feed conveyors 118, 120 move the compressed or partially compressed stacks 114 in the downstream direction along the conveying path 115 toward a wrapping station 146 and toward lower and upper discharge conveyors 154, 156. The lower discharge conveyor 154 can include a belt 160, which moves in the downstream direction along the conveying path 115 around pulleys 162, and the upper discharge conveyor 156 can include a belt 164, which also moves in the downstream direction along the conveying path 115 around pulleys 166 at substantially the same speed as the belt 160 of the lower discharge conveyor 154. In other embodiments, one or both of the lower and upper discharge conveyors 154, 156 can be a vacuum belt, a high friction belt, a paddle conveyor, or any other suitable device for moving the stacks 114 in the downstream direction along the conveying path 115.

In the illustrated embodiment of FIGS. 5-11, the bander apparatus 110 includes a first wrapping assembly 170 positioned below the wrapping station 146 and a second wrapping assembly 172 positioned above the wrapping station 146. In other embodiments, the bander apparatus 110 can include a single wrapping assembly 170 located below the wrapping station 146, or alternatively, the bander apparatus 110 can include a single wrapping assembly 172 located above the wrapping station 146. In still other embodiments, one or more wrapping assemblies can be located in other orientations with respect to the wrapping station 146.

As shown in FIGS. 5-9, the first wrapping assembly 170 includes a supply of wrap material 112. In the illustrated embodiment, wrap material 112 is wound around a supply roll 176, which is supported on a mandrel or spindle 178. The first wrapping assembly 170 can also include an unwind drive assembly (e.g., an internal-combustion engine, a variable speed drive, a servo motor, a stepper motor, an induction motor, a synchronous reluctance motor, a brush-less motor, a brush-type motor, and the like) 180, which selectively rotates the supply roll 176 about the spindle 178 to unwind wrap material 112 from the supply roll 176 and to supply wrap material 112 to the wrapping station 146. As explained in greater detail below, the rotational speed of the spindle 178 can be adjusted to control the rate at which wrap material 112 is supplied to the wrapping station 146 and to accommodate the changing outer diameter of the roll 176 as wrap material 112 is consumed.

The first wrapping assembly 170 can also include a drive assembly 184, which is operable to receive wrap material 112 from the supply roll 176 and to positively feed the wrap material 112 toward the conveying path 115. In some embodiments, the drive assembly 184 includes pull rolls 186, 188, which are located between the supply roll 176 and the wrapping station 146. A servo motor or another similar drive (e.g., an internal-combustion engine, a variable speed drive, a stepper motor, an induction motor, a synchronous reluctance motor, a brush-less motor, a brush-type motor, and the like) 190 is located adjacent to the rolls 186, 188 and is operable to rotate the rolls 186, 188 in opposite directions about their respective axes to draw wrap material 112 from the supply roll 176 and to direct the wrap material 112 through a cutting assembly 192 and upwardly toward the wrapping station 146. In other embodiments, other conventional drive assemblies (e.g., shuttles, paddle conveyors, vacuum belts, and the like) can be used to receive wrap material 112 from the supply roll 176 and to positively feed the wrap material 112 toward the conveying path 115.

In the illustrated embodiment of FIGS. 6-9, the cutting assembly 192 includes an anvil 194 and a rotatable cutting roll 196 spaced a distance from the anvil 194. Together, the anvil 194 and the cutting roll 196 define a nip 198. The anvil 194 includes a knife blade 200, which extends toward the cutting roll 196 across at least a portion of the nip 198. The cutting roll 196 is rotatable about its own axis and includes an outwardly extending knife blade 202 so that as the cutting roll 196 rotates about its axis, the blade 202 of the cutting roll 196 is selectively and intermittently aligned with the blade 200 of the anvil 194 to clean cut wrap sheets 204 from the wrap material 112.

In other embodiments, the cutting assembly 192 can include other cutting elements and cutting blades which are selectively and intermittently engageable to cut wrap sheets 204 from the wrap material 112. For example, in some embodiments (not shown), the cutting assembly 192 can include a pair of rotatable cutting rolls having outwardly extending blades, which are selectively and intermittently engageable to cut wrap sheets 204 from the wrap material 112.

As used herein and in the appended claims the term "clean cut" refers to cuts and methods of cutting that substantially separate two items, as opposed to cuts and methods of cutting that perforate an item or partially separate two items. The term "clean cut" as used herein and in the appended claims is not meant to imply or dictate that a cut is straight or that the cut items do not have outwardly extending strands, tabs, tassels, or threads.

The rotational speed of the cutting roll 196, the diameter of the cutting roll 196, and the feed rate of the wrap material 112 are selected so that the wrap sheets 204 are cut to have a size corresponding to the size of the stacks 114. More specifically, in some embodiments and as shown in FIGS. 6-9, the rotational speed of the cutting roll 196, the diameter of the cutting roll 196, and the feed rate of the wrap material 112 are selected to provide wrap sheets 204 having a length measured from a first end to a second end which is substantially equal to the length of a stack 114 measured between a leading edge and a trailing edge. In these embodiments, the rotational speed of the cutting roll 196, the diameter of the cutting roll 196, and the feed rate of the wrap material 112 can be adjusted to cut smaller or larger wrap sheets 204 for wrapping smaller or larger stacks 114.

Figure 7:
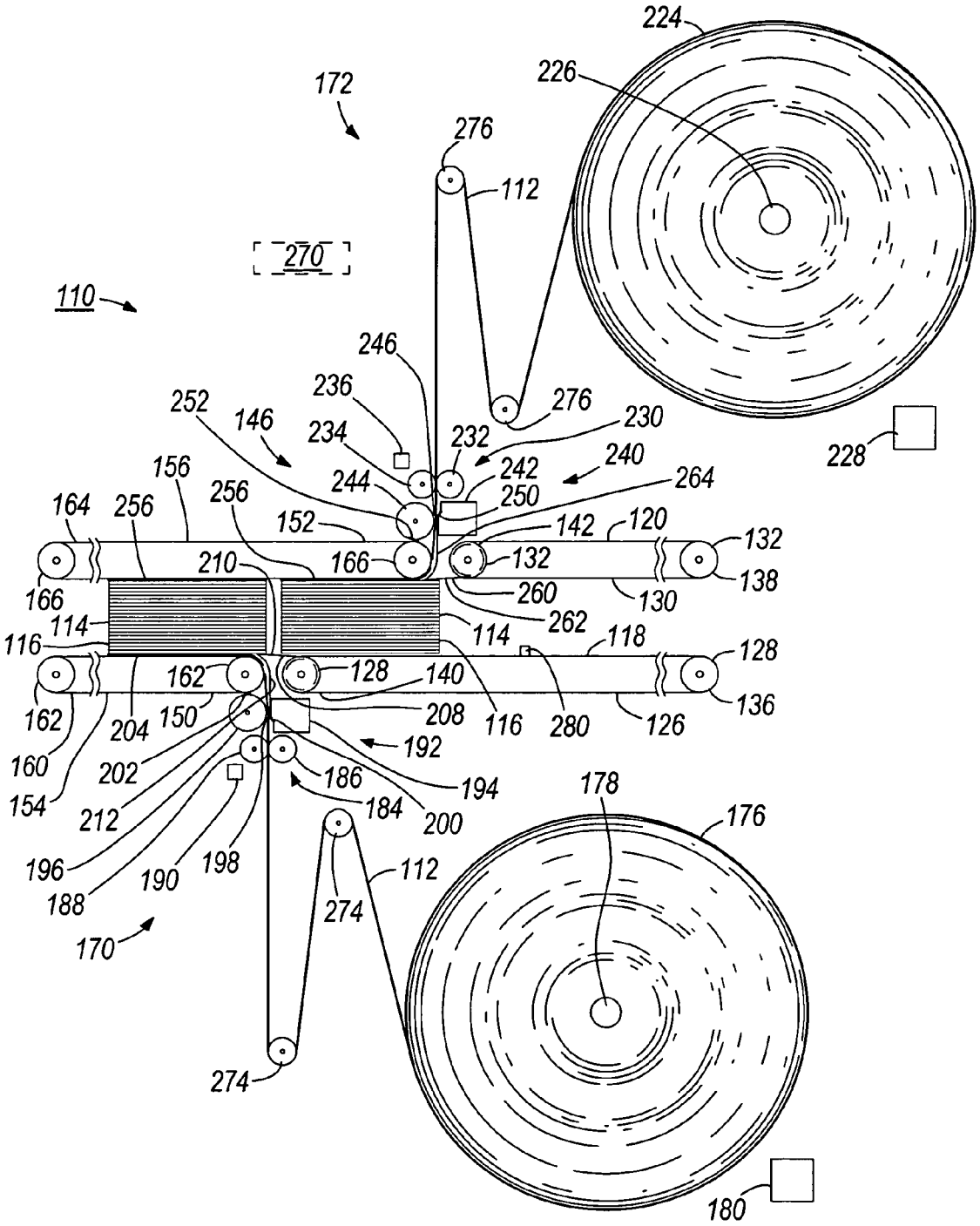
FIG. 7 is a schematic view of the banding apparatus illustrated in FIG. 5, showing leading edges of the wrap web material being fed toward the conveying path.
Figure 8:
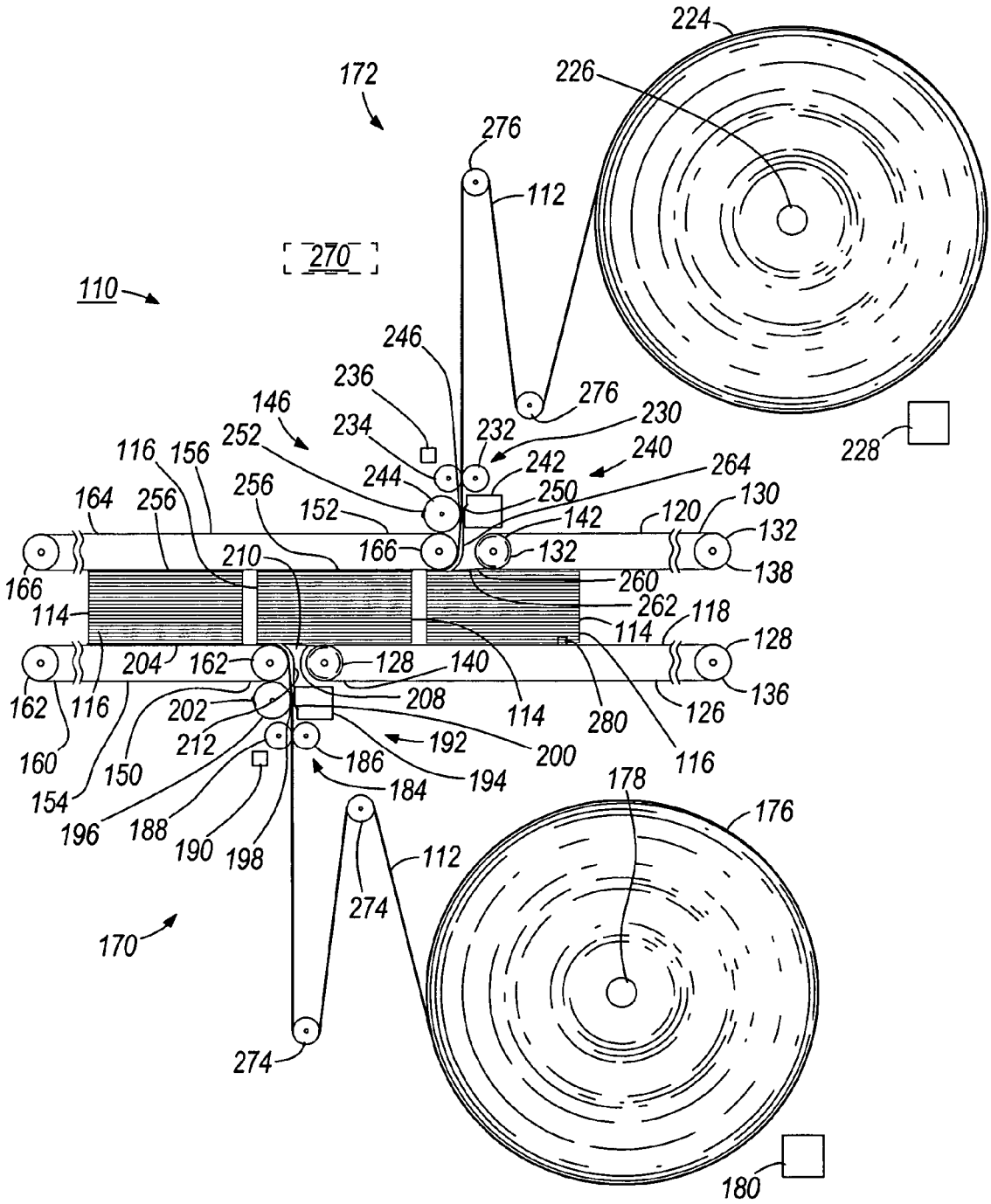
FIG. 8 is a schematic view of the banding apparatus illustrated in FIG. 5, showing leading edges of the wrap web material being fed adjacent stacks.

With respect to the illustrated embodiment of FIGS. 5-9, when the blade 202 of the cutting roll 196 and the blade 200 of the anvil 194 are not aligned, as shown in FIGS. 7 and 8, the pull rolls 186, 188 rotate about their axes and force the wrap material 112 upwardly toward the wrapping station 146 between the downstream end 140 of the lower feed conveyor 118 and the upstream end 150 of the lower discharge conveyor 154.

In some embodiments, the first wrapping assembly 170 includes a guide 208 for directing the wrap material 112 upwardly toward the wrapping station 146 between the downstream end 140 of the lower feed conveyor 118 and the upstream end 150 of the lower discharge conveyor 154. In the illustrated embodiment of FIGS. 6-9, the guide 208 is located between the downstream end 140 of the lower feed conveyor 118 and the upstream end 150 of the lower discharge conveyor 154. An upper surface 210 of the guide 208 can extend across at least a portion of the distance between the upper surface of the lower feed conveyor 118 and the upper surface of the lower discharge conveyor 154. In operation, the upper surface 210 of the guide 208 prevents stacks 114 from becoming stuck or lodged between the lower feed conveyor 118 and the lower discharge conveyor 154 as the stacks 114 move through the wrapping station 146.

In the illustrated embodiment of FIGS. 6-9, the guide 208 includes a lip 212, which extends downwardly from the upper surface 210 toward the cutting assembly 192. As shown in FIGS. 6-9, at least a portion of the lip 212 can be curved. In operation, as the pull rolls 186, 188 push the wrap sheets 204 upwardly between the downstream end 140 of the lower feed conveyor 118 and the upstream end 150 of the lower discharge conveyor 154, the leading edges of the wrap sheets 204 contact the lip 212, which directs the leading edges of the wrap sheets 204 downstream toward the upstream end 150 of the lower discharge conveyor 154.

As mentioned above, in some embodiments, such as the illustrated embodiment of FIGS. 5-9, the bander apparatus 110 includes a second wrapping assembly 172 positioned above and between the downstream end 142 of the upper feed conveyor 120 and the upstream end 152 of the upper discharge conveyor 156. In these embodiments, the second wrapping assembly 172 includes a supply of wrap material 112. In the illustrated embodiment, wrap material 112 is wound around a supply roll 224, which is supported on a mandrel or spindle 226.

The second wrapping assembly 170 can also include an unwind drive assembly (e.g., an internal-combustion engine, a variable speed drive, a servo motor, a stepper motor, an induction motor, synchronous reluctance motors, brush-less motors, brush-type motors, and the like) 228, which selectively rotates the supply roll 224 about the spindle 226 to unwind wrap material 112 from the supply roll 224 and to supply wrap material 112 to the wrapping station 146. As explained in greater detail below, the rotational speed of the spindle 226 can be adjusted to control the rate at which wrap material 112 is supplied to the wrapping station 146 and to accommodate the changing outer diameter of the supply roll 224 as wrap material 112 is consumed.

The second wrapping assembly 172 can also include a drive assembly 230, which is operable to receive wrap material 112 from the supply roll 224 and to positively feed the wrap material 112 toward the conveying path 115. In some embodiments, the drive assembly 230 includes pull rolls 232, 234, which are located between the supply roll 224 and the wrapping station 146. A servo motor or another similar drive (e.g., an internal-combustion engine, a variable speed drive, a stepper motor, an induction motor, synchronous reluctance motors, brush-less motors, brush-type motors, and the like) 236 is located adjacent to the rolls 232, 234 and is operable to rotate the rolls 232, 234 in opposite directions about their respective axes to draw the wrap material 112 from the supply roll 224 and to direct the wrap material 112 through a cutting assembly 240 and downwardly toward the wrapping station 146. In other embodiments, other conventional drive assemblies (e.g., shuttles, paddle conveyors, vacuum belts, and the like) can also be used to receive wrap material 112 from the supply roll 224 and to positively feed the wrap material 112 toward the conveying path 115.

In the illustrated embodiment of FIGS. 6-9, the cutting assembly 240 includes an anvil 242 and a rotatable cutting roll 244 spaced a distance from the anvil 242. Together, the anvil 242 and the cutting roll 244 define a nip 246. The anvil 242 includes a knife blade 250, which extends toward the cutting roll 244 across at least a portion of the nip 246. The cutting roll 244 is rotatable about its own axis and includes an outwardly extending knife blade 252 so that as the cutting roll 244 rotates about its axis, the blade 252 of the cutting roll 244 is selectively and intermittently aligned with the blade 250 of the anvil 242 to clean cut wrap sheets 256 from the wrap material 112.

In other embodiments, the cutting assembly 240 can include other cutting elements and cutting blades which are selectively and intermittently engageable to cut wrap sheets 256 from the wrap material 112. For example, in some embodiments (not shown), the cutting assembly 240 can include a pair of rotatable cutting rolls having outwardly extending blades, which are selectively and intermittently engageable to cut wrap sheets 256 from the wrap material 112.

The rotational speed of the cutting roll 244, the diameter of the cutting roll 244, and the feed rate of the wrap material 112 are selected so that the wrap sheets 256 are cut to have a size corresponding to the size of the stacks 114. More specifically, in some embodiments and as shown in FIGS. 6-9, the rotational speed of the cutting roll 244, the diameter of the cutting roll 244, and the feed rate of the wrap material 112 are selected to provide wrap sheets 256 having a length measured from a first end to a second end which is substantially equal to the length of a stack 114 measured between a leading edge and a trailing edge. In these embodiments, the rotational speed of the cutting roll 244, the diameter of the cutting roll 244, and the feed rate of the wrap material 112 can be adjusted to cut smaller or larger wrap sheets 256 for wrapping smaller or larger stacks 114.

With respect to the illustrated embodiment of FIGS. 5-9, when the blade 252 of the cutting roll 244 and the blade 250 of the anvil 242 are not aligned, as shown in FIGS. 7 and 8, the pull rolls 232, 234 rotate about their axes and force the wrap material 112 downwardly toward the wrapping station 146 between the downstream end 142 of the upper feed conveyor 120 and the upstream end 152 of the upper discharge conveyor 156.

In some embodiments, the second wrapping assembly 172 includes a guide 260 for directing the wrap material 112 downwardly toward the wrapping station 146 between the downstream end 142 of the upper feed conveyor 120 and the upstream end 152 of the upper discharge conveyor 156. In the illustrated embodiment of FIGS. 6-9, the guide 260 is located between the downstream end 142 of the upper feed conveyor 118 and the upstream end 152 of the upper discharge conveyor 156. A lower surface 262 of the guide 260 can extend across at least a portion of the distance between the lower surface of the upper feed conveyor 120 and the lower surface of the upper discharge conveyor 156. In operation, the lower surface 262 of the guide 260 prevents stacks 114 from becoming stuck or lodged between the upper feed conveyor 120 and the upper discharge conveyor 156 as the stacks 114 move through the wrapping station 146.

In the illustrated embodiment of FIGS. 5-9, the guide 260 also includes a lip 264, which extends upwardly from the lower surface 262 toward the cutting assembly 240. As shown in FIGS. 6-9, at least a portion of the lip 262 can be curved. In operation, as the pull rolls 232, 234 push wrap sheets 256 downwardly between the downstream end 142 of the upper feed conveyor 120 and the upstream end 152 of the upper discharge conveyor 156, the leading edges of the wrap sheets 256 contact the lip 264, which directs the leading edges of the wrap sheets 256 downstream toward the upstream end 152 of the upper discharge conveyor 156.

In some embodiments, the bander apparatus 110 also includes a controller 270, which controls and coordinates operation of the first and/or second wrapping assemblies 170, 172. For example, in some embodiments, the controller 270 controls and coordinates operation of the lower and upper feed conveyors 118, 120 and the lower and upper discharge conveyors 154, 156. In these embodiments, the controller 270 ensures that the lower and upper feed conveyors 118, 120 and the lower and upper discharge conveyors 154, 156 operate at controlled speeds (e.g., between about 200 and 230 feet/minute). In other embodiments, the bander apparatus 110 can include a timing belt (not shown) that ensures that the lower and upper feed conveyors 118, 120 and the lower and upper discharge conveyors 154, 156 operate at controlled speeds.

The controller 270 can also control and coordinate operation of the cutting rolls 196, 244. In these embodiments, the controller 270 ensures that the cutting rolls 196, 244 rotate at a desired speed to cut wrap sheets 204, 256 having a desired length. In addition, in some embodiments, the controller 270 can be programmed to increase or decrease the rotational speed of the cutting rolls 196, 244 to increase or decrease the length of the wrap sheets 204, 256 supplied to the wrapping station 146.

The controller 270 can also control and coordinate operation of the drive assemblies 184, 230 to ensure that sufficient wrap material 112 is being supplied to the cutting assemblies 192, 240, respectively. In these embodiments, the controller 270 is operable to selectively increase or decrease the rotational speed of one or both of the drive assemblies 184, 230 to selectively increase or decrease the size of the wrap sheets 204, 256.

In some embodiments, the controller 270 is operable to adjust the rotational speed of the supply rolls 176, 224. In these embodiments, the first wrapping assembly 170 can include one or more dancer rolls 274 located between the supply roll 176 and the drive assembly 184 and the second wrapping assembly 172 can include one or more dancer rolls 276 located between the supply roll 224 and the drive assembly 230. In these embodiments, the controller 270 can be in communication with the dancer rolls 274, 276 to receive data relating to the tension in the wrap material 112 between the supply roll 176 and the drive assembly 184 and between the supply roll 224 and the drive assembly 230. By comparing the tension data to preprogrammed tension data, the controller 270 can determine whether the supply rolls 176, 224 are rotating at a desired rotational speed. In addition, if the supply rolls 176, 224 are not rotating at a desired rotational speed, the controller 270 can be programmed to increase or decrease the rotational speed of the supply rolls 176, 224 to ensure that wrap material 112 is continuously supplied to the wrap station 146.

In some embodiments, the controller 270 can also be programmed to increment the rotational speed of the supply rolls 176, 224 in response to the changing diameters of the supply rolls 176, 224 as wrap material 112 is consumed. In these embodiments, the controller 270 can be programmed to increase the rotational speed of the supply rolls 176, 224 as wrap material 112 is consumed and as the diameters of the supply rolls 176, 224 decrease.

In other embodiments, the bander apparatus 110 can include position sensors (e.g., photo gates, position switches, etc.) 280 positioned along the conveyor path 115 to record the position of the stacks 114. In some such embodiments, the controller 270 is operable to adjust the operating speed of one or more of the lower and upper feed conveyors 118, 120, the lower and upper discharge conveyors 154, 156, the unwind drive assemblies 180, 228, the drive assemblies 184, 230, and the cutting assemblies 192, 240 based upon stack position data received from the position sensors 280 to ensure that the wrap sheets 204, 256 are properly aligned on the bottom and top surfaces of the stacks 114.

The controller 270 can also be programmed to adjust the operating speed of one or more of the lower and upper feed conveyors 118, 120, the lower and upper discharge conveyors 154, 156, the unwind drive assemblies 180, 228, the drive assemblies 184, 230, and the cutting assemblies 192, 240 to accommodate differently sized stacks 114. In some such embodiments, the controller 270 can be programmed to adjust one or more of the above-mentioned operating speeds based upon stack size data received from the sensors 280.

In addition, in some embodiments, the bander apparatus 110 can be operated to cut wrap sheets 204, 256 having a number of different sizes corresponding to a number of differently sized stacks 114. Specifically, the bander apparatus 110 can be operated to cut wrap sheets 204, 256 having a length measured between a leading edge and a trailing edge of six feet or more. The bander apparatus 110 of the present invention can also be operated to cut wrap sheets 204, 256 having a length measured between a leading edge and a trailing edge of six inches or less.

In other embodiments, the bander apparatus 110 can be operated to cut wrap sheets 204, 256 having still shorter lengths, with the minimum length of the wrap sheets 204, 256 being limited only by the distance between the drive assemblies 184, 230 and the wrapping station 146. As mentioned above, conventional banding apparatuses pinch the wrap sheets between conveyors and stacks of web product so that the conveyors can pull the wrap sheets into engagement with the stacks. Such conventional banding apparatuses are unable to pinch shorter wrap sheets and are therefore unable to wrap relatively small stacks. The bander apparatus 110 of the present invention can wrap shorter stacks than conventional banding apparatuses because, among other things, the drive assemblies 184, 230 positively feed wrap sheets 204, 256 toward the wrapping station 146 and therefore do not require longer wrap sheets 204, 256.

FIGS. 6-9 best illustrate the operation of the bander apparatus 10 of the present invention. Beginning with FIG. 6, the lower and upper feed conveyors 118, 120 move stacks 114 along the conveying path 115 toward the wrapping station 146. In embodiments having wrapping assemblies 170 positioned between the lower feed conveyor 118 and the lower discharge conveyor 154, the pull rolls 186, 188 of the first wrapping assembly 170 draw web material 112 from the supply roll 176 and feed the web material 112 toward the cutting assembly 192.

Figure 9:
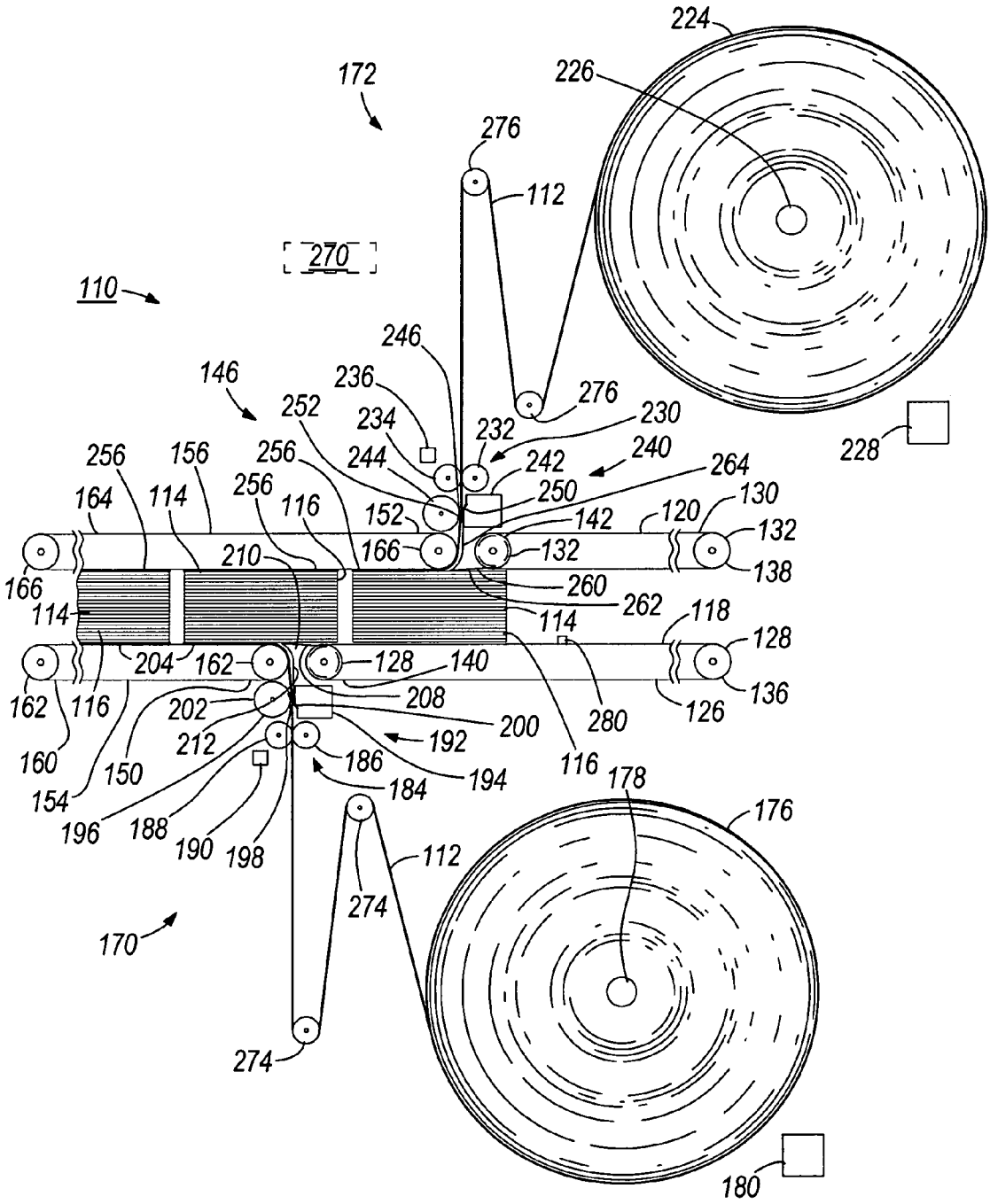
FIG. 9 is a schematic view of the banding apparatus illustrated in FIG. 5, showing cutting rolls cutting the wrap web material.
Figure 10:
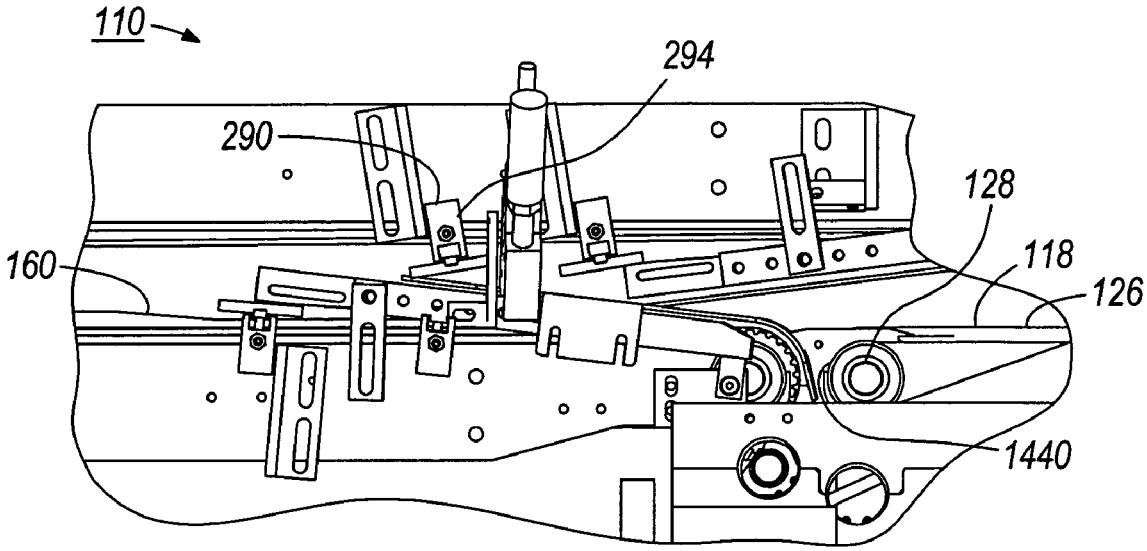
FIG. 10 is a cross sectional view taken along line 10-10 of FIG. 5, showing a guide assembly.
Figure 11:
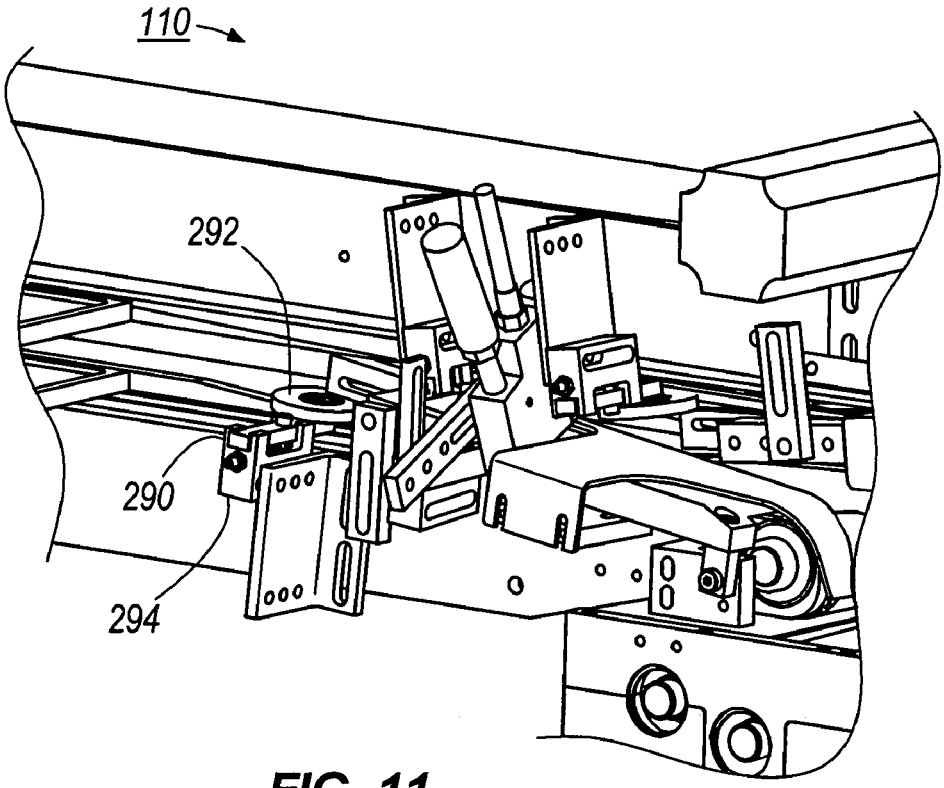
FIG. 11 is a side view of the guide assembly illustrated in FIG. 10.
Figure 12A:
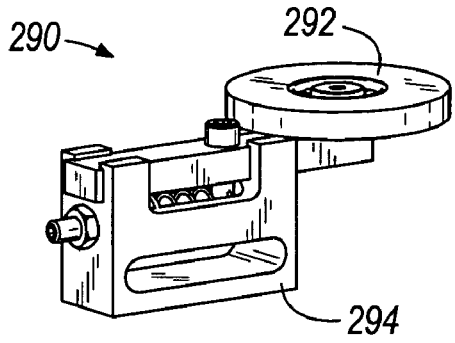
FIG. 12A is a perspective view of the guide assembly illustrated in FIG. 10.
Figure 12B:
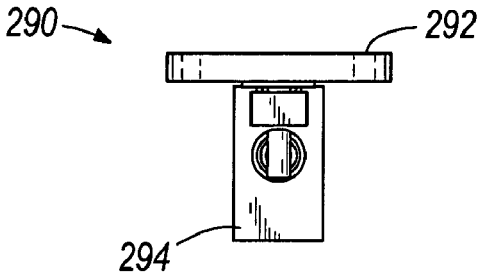
FIG. 12B is a front view of the guide assembly illustrated in FIG. 10.
Figure 12C:
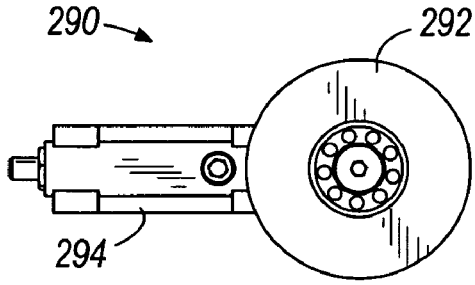
FIG. 12C is a bottom view of the guide assembly illustrated in FIG. 10.
Figure 12D:
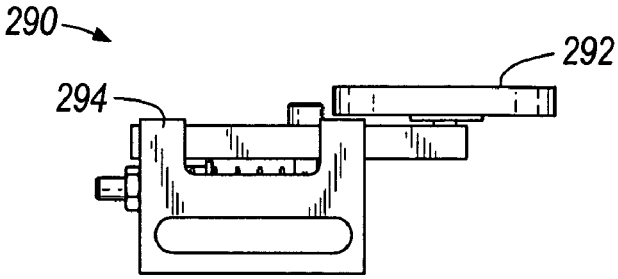
FIG. 12D is a side view of the guide assembly illustrated in FIG. 10.

As shown in FIGS. 8 and 9, the pull rolls 186, 188 feed the wrap material 112 between the anvil 194 and the cutting roll 196 and direct the wrap material 112 upwardly toward the wrapping station 146. In embodiments having a guide 208, the guide 208 also or alternately directs the leading edge of the wrap material 112 upwardly and laterally toward the conveying path 115.

With reference to FIG. 9, as the leading edge of the wrap material 112 contacts the upstream end 150 of the lower discharge conveyor 154, the lower feed conveyor 118 moves a stack 114 across the upper surface 210 of the guide 208 and onto the leading edge of the wrap sheet 204, pinching the leading edge 112 of the wrap material 112 between the lower discharge conveyor 154 and the leading edge of the stack 114. The lower discharge conveyor 154 and the drive assembly 184 then cooperate to feed the wrap material 112 through the wrapping station 146 until the blade 202 of the cutting roll 196 is rotated into engagement with the blade 200 of the anvil 194, thereby cutting a wrap sheet 204 from the wrap material 112.

As shown in FIG. 9, the lower discharge conveyor 154 continues to feed the wrap sheet 204 upwardly toward and along the conveying path 115 until the wrap sheet 204 is positioned on the lower surface of the stack 114 with the leading edge of the wrap sheet 204 being aligned with the leading edge of the stack 114 and the trailing edge of the wrap sheet 204 being aligned with the trailing edge of the stack 114.

In embodiments having wrapping assemblies 172 positioned above and between the upper feed conveyor 120 and the upper discharge conveyor 156, the pull rolls 232, 234 of the second wrapping assembly 172 draw web material 112 from the supply roll 224 and feed the web material 112 toward the cutting assembly 240. As shown in FIGS. 6 and 7, the pull rolls 232, 234 feed the wrap material 112 between the anvil 242 and the cutting roll 244 and direct the wrap material 112 downwardly toward the wrapping station 146. In embodiments having a guide 260, the guide 260 also or alternately directs the leading edge of the wrap material 112 downwardly and laterally toward the conveying path 115.

As shown in FIG. 6, as the leading edge of the wrap material 112 contacts the upstream end 152 of the upper discharge conveyor 156, the upper feed conveyor 120 moves a stack 114 across the lower surface 262 of the guide 260 and onto the leading edge of the wrap sheet 256, pinching the leading edge of the wrap material 112 between the upper discharge conveyor 156 and the leading edge of the stack 114. The upper discharge conveyor 156 and the drive assembly 230 then cooperate to feed the wrap material 112 through the wrapping station 146 until the blade 252 of the cutting roll 244 is rotated into engagement with the blade 250 of the anvil 242, thereby cutting a wrap sheet 256 from the wrap material 112.

As shown in FIG. 7, the upper discharge conveyor 156 continues to feed the wrap sheet 256 downwardly toward and along the conveying path 115 until the wrap sheet 256 is positioned on the upper surface of the stack 114 with the leading edge of the wrap sheet 256 being aligned with the leading edge of the stack 114 and the trailing edge of the wrap sheet 204 being aligned with the trailing edge of the stack 114.

This process is then repeated as necessary to position wrap sheets on top and/or bottom sides of stacks 114 before the stacks 114 are directed downstream to other web processing and manufacturing apparatuses. For example, in some embodiments, the stacks 114 are directed downstream toward wrap folders (not shown, but readily understood by one skilled in the art), which fold sides of the bottom wrap sheets 204 upwardly and around at least a portion of the stacks 114 and which fold sides of the top wrap sheets 256 downwardly and around at least a portion of the stacks 114. In some such embodiments, the stacks 114 are directed further downstream toward adhesive applicators (also not shown, but readily understood by one skilled in the art), which apply adhesive to overlapping portions of the top and bottom wrap sheets 204, 256 to couple the top and bottom wrap sheets 204, 256 and to bind the wrap sheets 204, 256 around the stacks 114.

In some embodiments, such as the illustrated embodiment of FIGS. 5 and 10-12D, the bander apparatus 110 can also include a guide assembly 290, which can be located along the conveying path 115 between the lower and upper discharge conveyors 154, 156. In these embodiments, the guide assembly 290 can include a roller 292 and a biasing mechanism 294, which forces the roller 292 outwardly and into the conveying path 115. In these embodiments, the roller 292 engages the stacks 114 and aligns the sheets 116 in the stacks 114. The rollers 292 can also force folded sides of the top wrap sheets 256 downwardly and around at least a portion of the stacks 114 and can force folded sides of the lower wrap sheets 204 upwardly and around at least a portion of the stacks 114 to form a tighter wrap around the stacks 114. In some embodiments, the guide assembly 290 can be located downstream from adhesive applicators and is operable to press the adhesive and the wrap sheets 204, 256 together.

To improve the engagement between the outer surface of the rollers 292 and the stacks 114, or alternately, between the rollers 292 and the wrap sheets 204, 256, the outer surface of the roller 292 can be machined (e.g., knurled, grooved, and the like). Alternatively or in addition, the outer surface of the roller 292 can be at least partially covered with a high friction coating, such as a rubber coating.

Various features of the invention are found in the following claims.

What is claimed is:

1. A bander apparatus for wrapping stacks of web product with wrap web material supplied from a supply roll, the bander apparatus comprising:

a conveyor for supporting and moving the stacks to be wrapped along a conveying path;

a cutting assembly operable to cut wrap sheets from the wrap web material, a first wrap sheet having a first length;

a wrapping assembly including a drive assembly operable to receive wrap web material from the supply roll and positively feed the wrap web material to the conveying path; and a controller operable to control the cutting assembly and select a speed of the supply roll and a feed rate of wrap web material so that the first length is equal to a second length, the second length being defined between a leading edge of a first stack and a trailing edge of the first stack, the second length being defined parallel to movement of the conveyor along the conveying path.

2. The bander apparatus of claim 1, wherein the drive assembly includes a pair of pull rolls driven by at least one servo motor.

3. The bander apparatus of claim 2, wherein the controller is in communication with the at least one servo motor to determine the length of the wrap web material positively fed to the conveying path based on the rotations of the servo motor.

4. The bander apparatus of claim 1, wherein the drive assembly is positioned between the conveying path and the supply roll.

5. The bander apparatus of claim 1, wherein the wrap web material includes a leading edge and the stack includes a leading edge, the drive assembly operable to positively drive the leading edge of the wrap web material into the conveying path and into alignment with the leading edge of the stack.

6. The bander apparatus of claim 5, wherein the controller is in communication with the drive assembly, the controller operable to control the position of the leading edge by controlled adjustment of the drive assembly.

7. The bander apparatus of claim 6, further comprising a sensor in the conveying path, the controller in communication with the sensor and operable to determine the position of the leading edge of the stack.

8. The bander apparatus of claim 7, wherein the conveyor moves the stack at a speed, and wherein the controller is operable to adjust the drive assembly to substantially align the leading edge of the wrap web material with the leading edge of the stack in the conveying path based on the position of the leading edge of the stack and the speed of the conveyor.

9. The bander apparatus of claim 1, wherein the cutting assembly includes a cutting roll rotatable to clean cut the wrap web material received from the drive assembly to separate a wrap sheet from the wrap web material and define a trailing edge of the wrap sheet, the trailing edge delivered to the conveying path after the wrap sheet is separated from the wrap web material.

10. A method for wrapping stacks of web product with wrap web material supplied from a supply roll, the method comprising:

supporting and moving the stacks to be wrapped along a conveying path;

selecting a speed of the supply roll;

selecting a feed rate of the wrap web material;

receiving wrap web material from the supply roll;

cutting the wrap web material into wrap sheets, a first wrap sheet having a first length equal to a second length, the second length being defined between a leading edge of the a first stack and a trailing edge of the first stack, the second length being defined parallel to movement along the conveying path; and positively feeding the wrap web material to the conveying path with a drive assembly.

11. The method of claim 10, wherein positively feeding the wrap material includes driving a pair of pull rolls with at least one servo motor.

12. The method of claim 11, further comprising determining a length of the wrap web material positively fed to the conveying path based on the rotations of the at least one servo motor.

13. The method of claim 10, further comprising positioning the drive assembly between the conveying path and the supply roll.

14. The method of claim 10, further comprising positively driving a leading edge of the wrap web material into the conveying path and into alignment with a leading edge of the stack.

15. The method of claim 14, further comprising controlling the position of the leading edge by controlled adjustment of the drive assembly.

16. The method of claim 15, further comprising sensing the position of the leading edge of the stack.

17. The method of claim 16, further comprising adjusting the drive assembly to substantially align the leading edge of the wrap web material with the leading edge of the stack in the conveying path based on the position of the leading edge and a speed of a conveyor.

18. The method of claim 10, wherein cutting the wrap web material includes rotating a cutting roll to clean cut the wrap web material received from the drive assembly, separating a wrap sheet from the wrap web material, and defining a trailing edge of the wrap sheet.

19. The method of claim 18, further comprising delivering the trailing edge to the conveying path after the wrap sheet is separated from the wrap sheet material.

* * * * *